United States Patent [19]

Resnick et al.

[11] Patent Number: 4,829,551

[45] Date of Patent: May 9, 1989

[54] BIPHASE QUADRATURE DRIVE FOR AN X-RAY TUBE ROTOR

[75] Inventors: Theodore A. Resnick; Walter A. Dupuis, both of Cleveland Heights; William E. Szabo, North Olmstead, all of Ohio

[73] Assignee: Picker International, Inc., Highland Heights, Ohio

[21] Appl. No.: 143,514

[22] Filed: Jan. 13, 1988

[51] Int. Cl.[4] ..... H01J 35/10

[52] U.S. Cl. ..... 378/131; 378/93; 378/94

[58] Field of Search ..... 378/131, 93, 94, 102; 318/302, 309

[56] References Cited

U.S. PATENT DOCUMENTS

| | | | |
|---|---|---|---|
| 3,963,930 | 6/1976 | Fiocca et al. | 378/94 |
| 4,259,580 | 3/1981 | Vogler | 378/94 |
| 4,540,930 | 9/1985 | Siedband | 378/102 |

*Primary Examiner*—Carolyn E. Fields
*Assistant Examiner*—David P. Porta
*Attorney, Agent, or Firm*—Fay, Sharpe, Beall, Fagan, Minnich & McKee

[57] ABSTRACT

An x-ray tube (10) imaging system, such as a computed tomography scanner, includes a cathode (40) for generating a stream of electrons. A rotating anode (42) is placed in a path of the electron stream and generates x-rays as a result of collisions therewith. An induction rotor (44) causes rotation of the anode as a result of electromagnetic interaction with a stator (48) comprised of two windings: a run winding (50) and a phase winding (52). The run winding and the phase winding are connected to three nodes (54, 58, 60), one of which is common to both. The three nodes are actively driven with run, common, and phase signals, respectively. Actively driving the three nodes increases bus drive voltage over 40% over that achieved by half-bridge drives.

20 Claims, 7 Drawing Sheets

BIPHASE QUADRATURE DRIVE FOR AN X-RAY TUBE ROTOR

BACKGROUND OF THE INVENTION

The present invention relates to the electrical speed control and medical diagnosic arts. It finds particular application in controlling acceleration and deceleration of a rotating anode found in x-ray tubes used in conjunction with computed tomography scanners, and will be described with reference thereto. It is to be appreciated, however, that the invention may also find application in digital x-ray scanners, conventional x-ray, other x-ray medical and non-medical devices, other motor and rotation speed control applications, and the like.

A conventional x-ray tube includes a thermionic filament cathode and a rotating anode which are encased in an evacuated envelope. A heating current, commonly on the order of 2–5 amps, is applied through the filament to create a surrounding electron cloud. A high potential, e.g. 50–150 kilovolts, is applied between the filament and the anode to accelerate the electrons from the cloud to an anode target area. This acceleration of electrons causes a tube or anode current which is commonly on the order of 5–200 milliamps. To inhibit the target area from overheating, the anode rotates at a high operating speed during x-ray generation. When no x-rays are being generated, the anode may be allowed to decelerate.

In a computed tomography scanner, an x-ray tube is disposed radially outward of an imaging region and opposite to a plurality of sensors. Commonly, a fan beam of x-rays is generated by the tube, passes through a subject, and impinges on the sensor array. As the x-ray tube is rotated about the subject, the sensors generate a series of views from which an image is reconstructed. After each series of views from which an image is reconstructed. After each series of views or scan, the x-ray tube stops generating x-rays. If another scan is to follow, the anode may be kept rotating at full speed between scans. Historically, however, after most scans, the anode was permitted to slow or stop. Thus, the x-ray tube anode goes through frequency acceleration/deceleration cycles.

The rotating anode of an x-ray tube has one or more natural resonant frequencies, i.e. angular velocities at which the anode vibrates excessively. The vibration may damage the anode, as well as shorten the bearing life. It is accordingly desirable to minimize the time spent at the resonant angular velocity during acceleration and deceleration. During deceleration, the rotating anode is braked until it is below the resonant angular velocity. Thereafter, the anode coasts to a complete stop.

Conventional high speed drive circuits for x-ray tube anode motors include large, heavy, SCR type inverters, which feed three leads of a two winding stator. Two leads, a run lead and a quadrature lead, are actively driven. The third lead, a common lead, serves as a return line to the others. The windings were traditionally placed in a fixed split-capacitor drive mode.

The quadrature (or out-of-phase winding) is operated near its resonance frequency to accomplish a current phase shift between the windings. Because a wide range of x-ray tubes with widely varying motor characteristics may be used as a load, phase shift and ampere turn matching of the winding is often far from optimum. Multiple capacitors are commonly switched in and out to improve the matching for different stators and operating frequencies. Additionally, as the current level in the windings changes, the windings change temperature. The phase and relative magnitude of the current through the windings change correspondingly. This causes excessive current to be necessary to accelerate the rotor to its operating speed in the required time and to maintain the correct operating speed.

An additional problem is encountered when driving such two-coil induction motor driven x-ray tubes with a half-bridge driver. When utilizing a half-bridge driver, a single, common lead forms an input to both coils of the stator. Since the common lead is connected to a neutral point in the driver power supply, it is not possible to drive each coil independently at the maximum DC potential available.

To alleviate the above-noted phase and matching problems, two independent inverters can be provided; one for each winding. However, such dual-inverter systems are costly and bulky. Further, the dual inverter systems cannot operate at the low frequencies which are necessary to provide optimum AC braking, unless large output transformers are provided. To avoid the large output transformer, a DC brake voltage is often coupled, via a contactor, to the windings of the tube. While this is generally effective for braking, it does not provide good control over rotor speed during braking, particularly immediately before entering the coasting mode.

The present invention contemplates a new and improved method and apparatus for controlling acceleration/deacceleration of an anode rotor in an x-ray tube, which overcomes the above-referenced problems and others.

SUMMARY OF THE INVENTION

In accordance with the present invention, there is provided a speed control for controlling rotation of an anode in an x-ray tube. The tube includes a cathode for generating an electron stream to collide with the rotating anode to generate x-rays. An induction motor stator comprised of a run winding and phase winding drives a rotor connected to the anode. The run winding is fed by two actively driven leads, a first lead and a common lead. The phase winding is also fed by two actively driven leads, a second lead and the common lead. A voltage across the run winding is produced by connecting the first lead and the common lead across the full power supply potential. The voltage across the phase winding is also produced by connecting the second lead and the common lead across a full power supply potential. The current in each winding is therefore a function of an interaction of drive voltages in all three leads.

In accordance with a more limited aspect of the invention, means are provided for separately generating positive signals and negative signals for complementary portions of positive and negative polarities of each signal of each lead.

In accordance with a still more limited aspect of the present invention, means is provided for controlling the run winding current and a phase winding current by use of pulse width modulation.

A first advantage of the present invention is that it provides accurate control of rotational velocity.

An advantage of the present system of the present invention over a half-bridge driven system operating of a comparable source is the provision of an increased percentage of RMS current in each stator coil by proper phasing of three active signals, fed into the run winding and the phase winding by a first lead, a second lead, and a lead common to both.

Another advantage of the present invention is that it provides efficient braking for a rotating anode x-ray tube which safely decelerates the rotating anode to a selected velocity, generally below its lowest natural resonant frequency.

Yet another advantage of the present invention resides in reduced component costs.

Further advantages will become apparent to those of ordinary skill in the art upon a reading and understanding of the following detailed description.

BRIEF DESCRIPTION OF THE DRAWINGS

The invention may take physical form in certain parts and arrangement of parts or in various steps and arrangements of steps. The drawings are only for purposes of describing the preferred embodiment and are not to be construed as limiting the invention.

DETAILED DESCRIPTION OF THE PREFERRED EMBODIMENTS

Figures 1, 2:
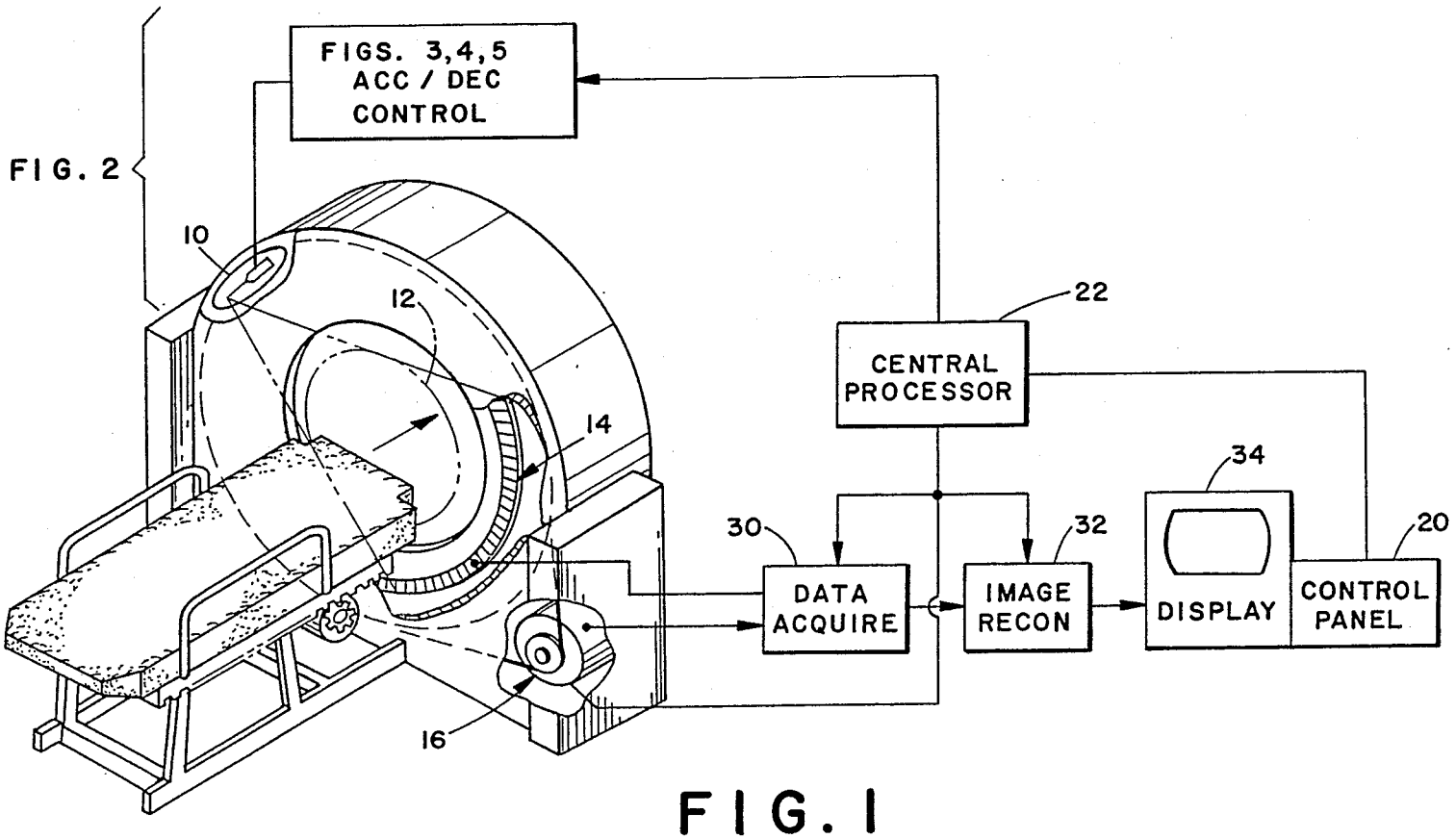
FIG. 1 is a diagramatic illustration of a CT scanner incorporating an improved x-ray tube control in accordance with the present invention.
FIG. 2 is block diagram of the x-ray tube acceleration/deceleration control circuitry of FIG. 1.
Figure 2:
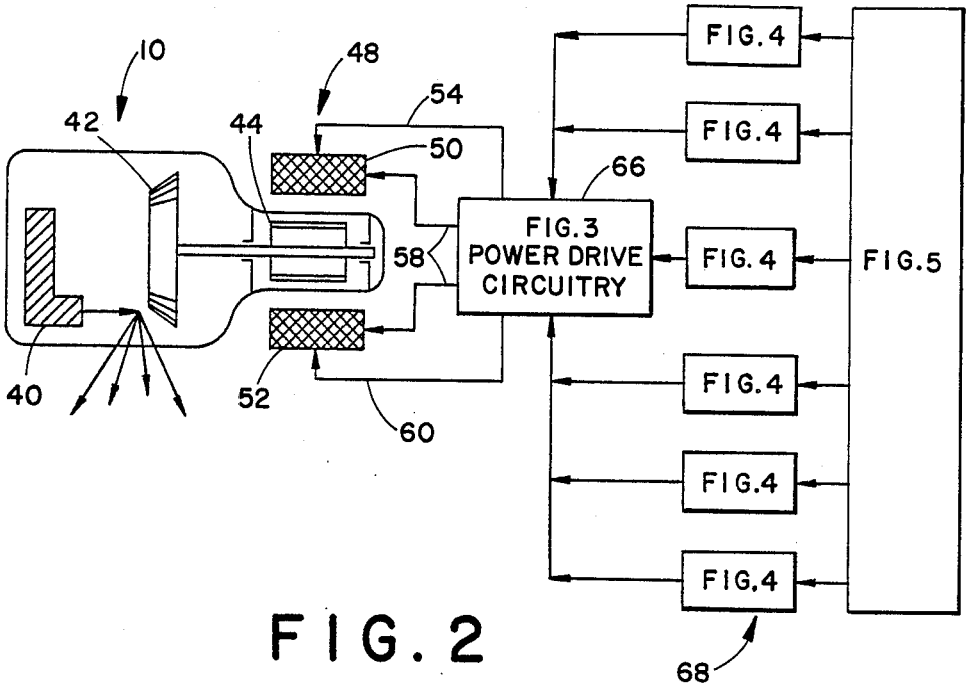

With reference to FIG. 1, a CT scanner includes an x-ray tube 10 which selectively projects a fan-shaped beam of X radiation across an image circle 12. The fan beam impinges on a radiation detection means, such as an array of detectors or sensor means 14. A fan beam rotating means 16 causes relative rotation movement of the radiation beam around the scan circle.

A control panel 20 enables the operator to select various system controls and events. The panel includes a switch or means for the operator to initiate a CT scan and means for selecting x-ray tube operating parameters, such as tube current and tube voltage. A central processor 22 controls the timing and operation of an x-ray tube control circuit 24 with other system components.

With continuing reference to FIG. 1 and further reference to FIG. 2, prior to initiating a scan, the x-ray tube is in a stand-by mode. Upon commencement of an x-ray scan, the central processor 22 causes the rotating means 16 to commence rotating the x-ray fan beam. Beam rotation commences after the x-ray tube has stabilized at the selected operating parameters to compensate for mechanical lag. when the tube has stabilized, a data aquisition means 30 collects x-ray intensity data from the x-ray detectors 14 an image processor 32 reconstructs the acquired data into an image representation. The image representation may be displayed on the display means 34, stored on tape or disk, or subjected to further processing.

Turning particularly to FIG. 2, x-rays are short-wave electromagnetic energy which can penetrate solid matter. They are produced when in a vacuum, electrons are released, accelerated, and then abruptly decelerated by collisions with appropriate material. This takes place in the x-ray tube 10. To release electrons, the filament of the tube or cathode means 40 is heated to incandesence (white heat) by passing electric current therethrough. The electrons are accelerated by a high voltage (ranging from about 10,000 to some hundreds of thousands of volts) between an anode 42 (positive) and the cathode 40 (negative). The accelerated electrons impinge upon the anode target, whereby they are abruptly slowed. In present day x-ray tubes, the anode target is conventionally of the rotating disk type. The electron beam is constantly striking a different portion of the anode perimeter to prevent overheating of the target portion. The x-ray tube envelope itself is generally made of glass, but is enclosed in a protective casing, which is filled with oil to absorb the heat radiated from the anode, which heat was produced along with the x-rays by the collisions of the electrons with the anode.

Rotation of the anode 42 is induced by an induction rotor 44 which is mechanically connected thereto. The rotor is in turn driven by electromagentic interaction with a stator 48, analogously to present day induction motors.

Stators of common induction motors generally comprise a minimum of two windings which are necessary to accelerate a rotor from a rest position. It has been found that a suitable rotation of the rotor in x-ray tubes is accomplished with a two phase winding system. Accordingly, the stator 48 includes a run winding 50 and a phase winding 52. The run winding 50 is driven by a voltage supplied across it by a first node 54 and a common node 58. The phase winding 52 is driven by a voltage supplied across it by a voltage supplied across it by a second node 60 and the common node 58. Accordingly, voltages supplied by connection to the common node 58 are supplied to both windings.

In the present system, all three leads are actively driven to facilitate control of acceleration, deceleration, and velocity of the rotor 44, which in turn governs rotation of the anode 42. The active drive signals are provided by a stator drive circuit 66, the operation of which will be described below in conjunction with FIG. 3. Phasing and timing are provided to the stator power drive circuit 66 by a plurality of base drive and isolation circuit means 68, the operation of which will be described below in conjunction with FIG. 4. The isolation circuits 68 are in turn driven by the phasing system of FIG. 5.

Figure 3:
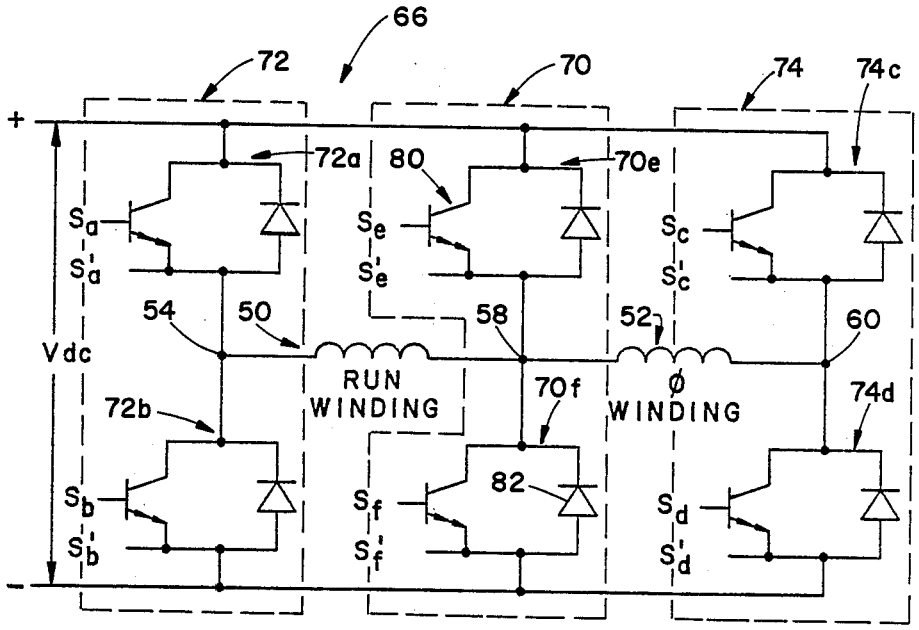
FIG. 3 is a schematic of the stator power drive circuit of the x-ray control of FIG. 2.

Turning now to FIG. 3, the stator drive signal coupling 66 includes circuitry or means 70 for supplying a common signal into the common node. Circuitry or means 72 supplies a run signal to the first mode. Circuitry or means 74 supplies a phase signal to the second node. Each of the signal supply means 70, 72, and 74 is further broken down into a positive signal portion and a negative signal portion. The common signal supply circuit 70 includes positive portion circuitry 70*e* and negative portion circuitry 70*f*. The phase signal supply circuit 74 includes positive portion 74*c* and negative portion 74*d*. The run signal supply circuit 72 includes positive portion circuitry 72*a* and negative portion circuitry 72*b*. Each of the positive and negative portion circuitry includes a transistor Darlington pair in parallel with a rectifier or diode.

The circuitry 70 results in an actively driven common node in a two winding stator system. Actively driving the common node results in an increased effective RMS current in both the run winding and the phase winding as will be further understood below.

For compactness of explanation, the circuitry 70*e* is described in detail and it will be understood that the description applies by analogy to like behaving circuits 70*f*, 72*a*, 72*b*, 74*c*, and 74*d*. The positive supply circuitry 70*e* has a Darlington pair 80 which may be selectively forward and reverse biased. A bias voltage of an appropriate magnitude is selectively applied between its base $S_e$ and its emitter S'e. When the Darlington pair 80 is "off" or in a reverse bias mode, conduction in the opposite direction may still occur through a rectification or diode means 82 which is in parallel to the emitter-collector junction of the Darlington pair 84. In this manner, current in run winding 52 or phase winding 54 may still have a travel path after termination of conduction through a Darlington pair.

By applying bias voltage pulses with the appropriate timing and magnitudes to each Darlington pair 70*e*, 70*f*, 72*a*, 72*b*, 74*c*, and 74*d*, appropriate phasing and current pulses are provided through the stator windings.

Figure 4:
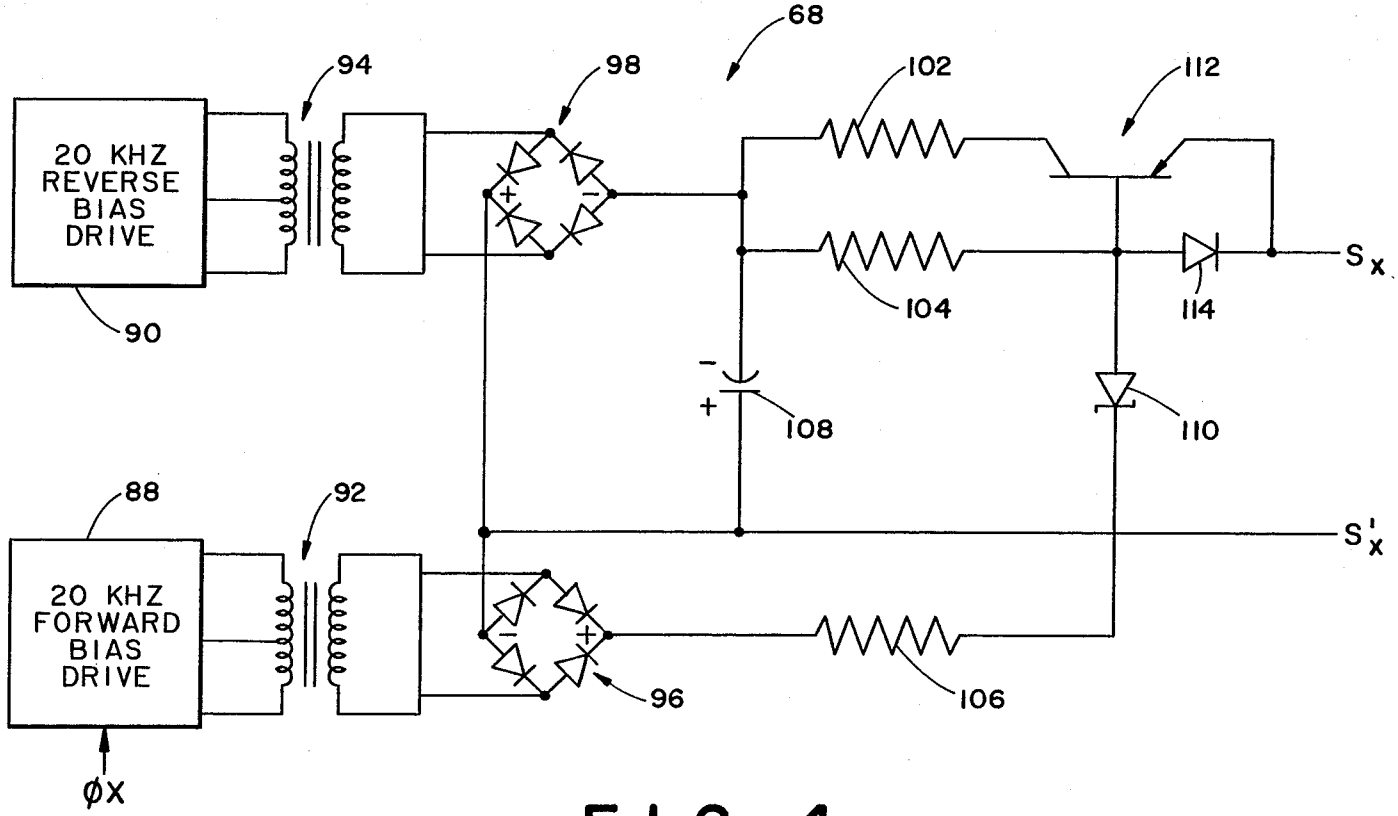
FIG. 4 is a schematic of a base drive and isolation circuitry for the stator drive of FIG. 3.

FIG. 4 describes the circuitry which supplies the bias voltage pulses to each darlington pair of FIG. 3. It will be understood that, as illustrated in FIG. 2, the present system contemplates six of the circuits 68, with one circuit acting in conjunction with each Darlington pair. The designations "x" and "x'" have been used to refer generically to applications to each of the alphabetic subscripts a-f used in the components of the circuit 70*e* ($S_e$, $S_e'$); 70*f* ($S_f$, $S_f'$); 72*a* ($S_a$, $S_a'$); 72*b* ($S_b$, $S_b'$); 74*c* ($S_c$, $S_c'$); and 74*d* ($S_d$, $S_d'$) of FIG. 3.

In FIG. 4, a forward bias drive means 88 and a reverse bias drive means 90 each provide an AC signal, e.g. a 20 kHz signal. As illustrated, the output from each bias drive means 88, 90 is comprised of three terminals indicative of the presence of a push-pull amplifier as is advantageously used in the preferred embodiment. Of course, other signal amplifier schemes will perform adequately as will be apparent to one of ordinary skill in the art. Output signals of bias drives 88, 90 are placed through isolation transformers 92, 94, respectively. The isolation transformers each function to convert its respective bias signal input level to that necessary to switch on (via transformer 92) or off (via transformer 94) the Darlington pair of FIG. 3 which is ultimately driven thereby. The forward bias drive 88 is adapted to be driven by a pulse width modulation signal for selectively enabling and disabling the forward bias signal of drive 88 which supplies the primary of isolation transformer 92, as will be seen further below.

An output of the secondary of transformer 92 is fed into a full wave bridge rectifier 96 to cause a positive bias signal. Similarly, an output of the secondary of transformer 94 is fed into a full wave bridge rectifier 98 to form a reverse bias voltage for switching off the subject Darlington pair. A bias pulse safety circuit including resistors 102, 104, and 106 and a capacitor 108, a zener diode 110 and diode 114 and a pnp gating transistor 112 assure that negative (reverse voltage bias is not provided concurrently on lines $S_x$ and $S'_x$ with the positive (forward) bias voltage. The diode 114 functions to reverse bias the base-emitter junction of transistor 112 when the threshold voltage of zener diode 110 has been exceeded, eliminating the reverse bias voltage at the base-emitter junction of a driven Darlington pair.

With a circuit constructed in the fashion of FIG. 4, a biasing voltage present at output terminals $S_x$ and $S'_x$ will automatically be switched from negative to positive when the forward bias drive 88 is enabled by the presence of signal $\phi_x$. Though a driven Darlington pair may be taken to an off state by mere absence of a positive bias (starvation), more accurate and assured switching is facilitted by a reverse or negative bias drive signal.

Figure 5:
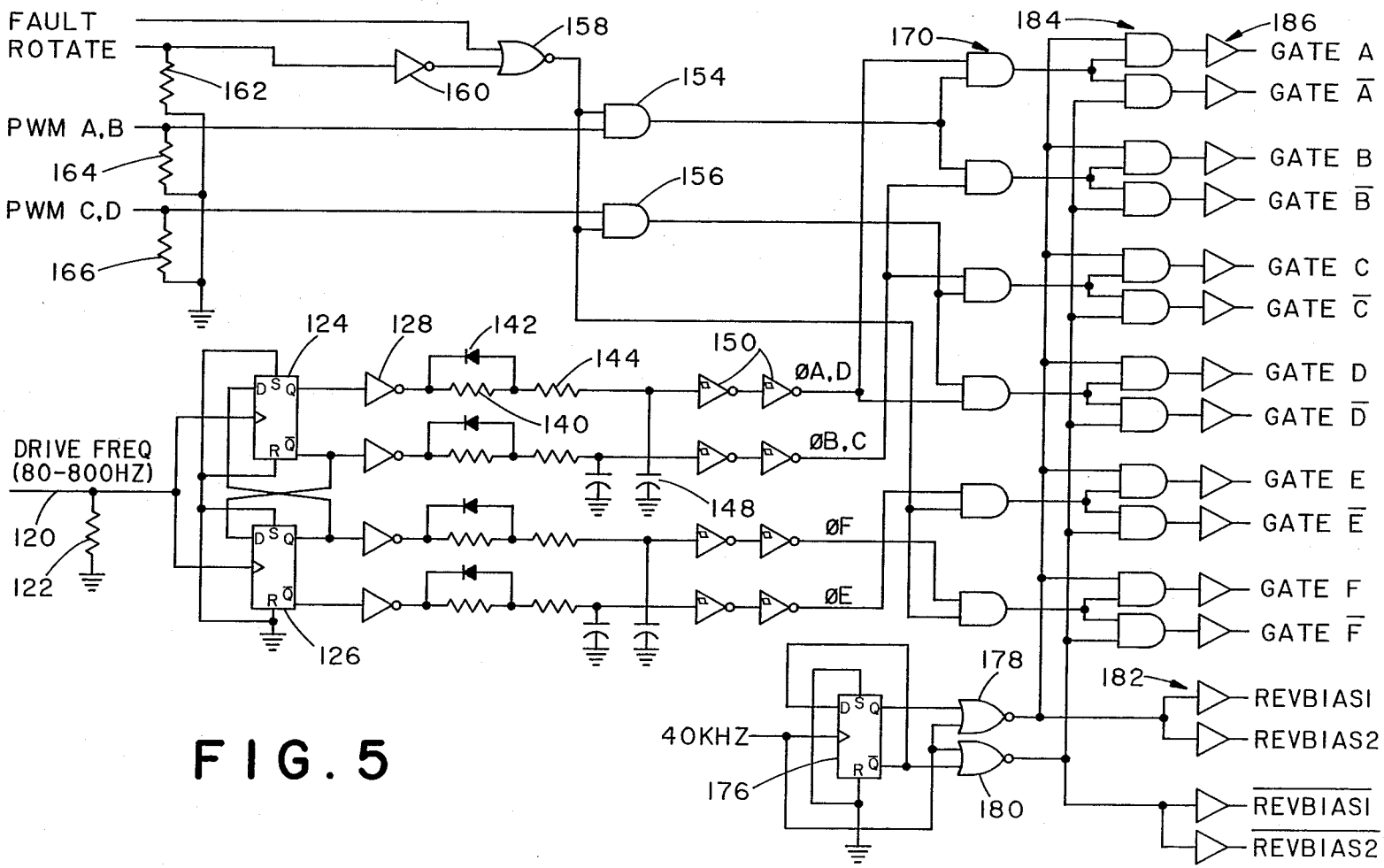
FIG. 5 is a schematic of a control circuit for producing phased and pulse width modulated control signals to the base drive and isolation circuits of FIG. 4.

FIG. 5 illustrates circuitry for supplying the forward and reverse bias signals to each of the isolation transformers 92, 94 of FIG. 4. It will be recalled that six such circuits as disclosed in FIG. 4 are disclosed in the control of the preferred embodiment. Signal sources for each of the circuits are provided by the circuitry illustrated by the schematic of FIG. 5.

The circuitry of FIG. 5 functions to work in conjunction with the circuitry of FIG. 4 to selectively enable and disable the Darlington pair transistors of FIG. 3. A drive frequency signal 120 is the clock signal for two D flip-flops 124, 126 which are connected in a feedback relationship to form four signals, two complementary pair in quadrature at 90° at their outputs (Q and complement Q). Each output from flip-flops 124, 126 is buffered through one of four buffer means, an exemplary one of the four being illustrated at 128. It is understood that the buffering and delay means, to be described below, function analogously for each output from each of the D flip-flops 124, 126, and accordingly discussion will be given for one for simplicity.

The output of buffer 128 is passed into resistor 140, which is parallel with diode 142, used to change the time constant of leading and trailing edges of the signals. The output of this parallel diode resistor combination forms and input to resistor 144 which is connected to ground through capacitor 148. Source current flow in a direction from the output of buffer 128 reverse biases the diode 142 and thereby passes through resistor 140. Flow in the opposite direction forward biases the diode 142, shorting out the resistor 140. Accordingly, resistor 144 and capacitor 148 form an R/C circuit with unequal charge and discharge times. The voltage thus resultant forms an input to a Schmitt trigger pair 150, which thereby implements a delay in accordance with the R/C time constant. As will be seen more clearly below, this delay is used to allow sufficient time for the turning off of a Darlington pair (FIG. 3) prior to commencement of current through another leg of the drive by enablement of another Darlington pair. This thereby prevents overlapping conduction of upper and lower Darlington transistors due to a lag in turn-off time of one with respect to turn-on time of the other.

Two pulse width modulation signals are adapted for placement into the system. A first pulse width modulation system (PWM, A, B) is input into AND gate 154 and a second pulse width modulation system (PWM C, D) forms an input to AND gate 156. Each of the AND gates 154, 156 has as another input, an output from NOR gate 158, which is in turn selected by a signal (FAULT) indicative of an error in the system, and a rotor on signal (ROTATE). The ROTATE signal is inverted through an inverter 160, as a low true signal has been defined.

The outputs from AND gates 154 and 156 are used to pulse width modulate the outputs from the Schmitt trigger pairs as will be best understood by a review of FIG. 5. These signals are combined in AND gates 170 as illustrated.

A "D" flip-flop, 176, is interconnected as illustrated, and has input thereto, as illustrated a 40 kHz reference signal. When so connected, a 20 kHz signal and its complement are generated at an output of each of NOR gates 178, 180. These outputs pass through buffers 182, and then to a push-pull amplifier (not illustrated) which thereby completes the reverse bias drive means 90 (FIG. 4).

The signals from NOR gates 178, 180 are also coupled with the output from AND gates 170 and AND gates 184, as illustrated. The outputs from AND gates 184 form six phase signals, and their complementary outputs. These are buffered through buffers 186. The output from the buffers pass to a push-pull amplifier (not illustrated) to complete the forward phase bias drive circuit of FIG. 4.

Figure 6:
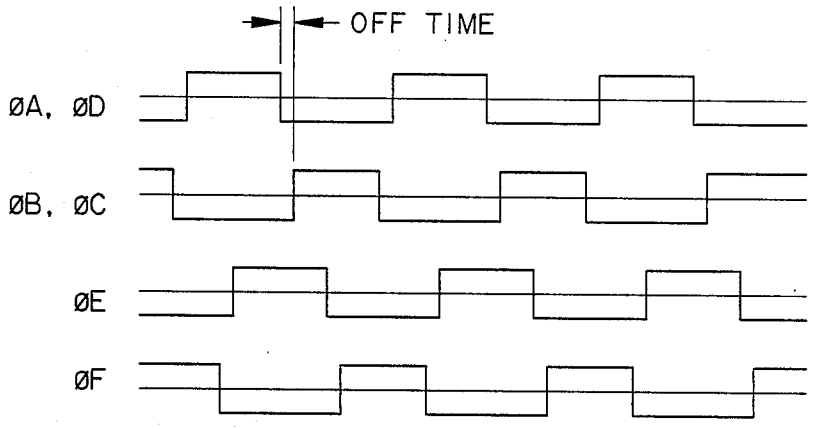
FIG. 6 is a timing diagram of the output of the circuit of FIG. 5.
Figure 7:
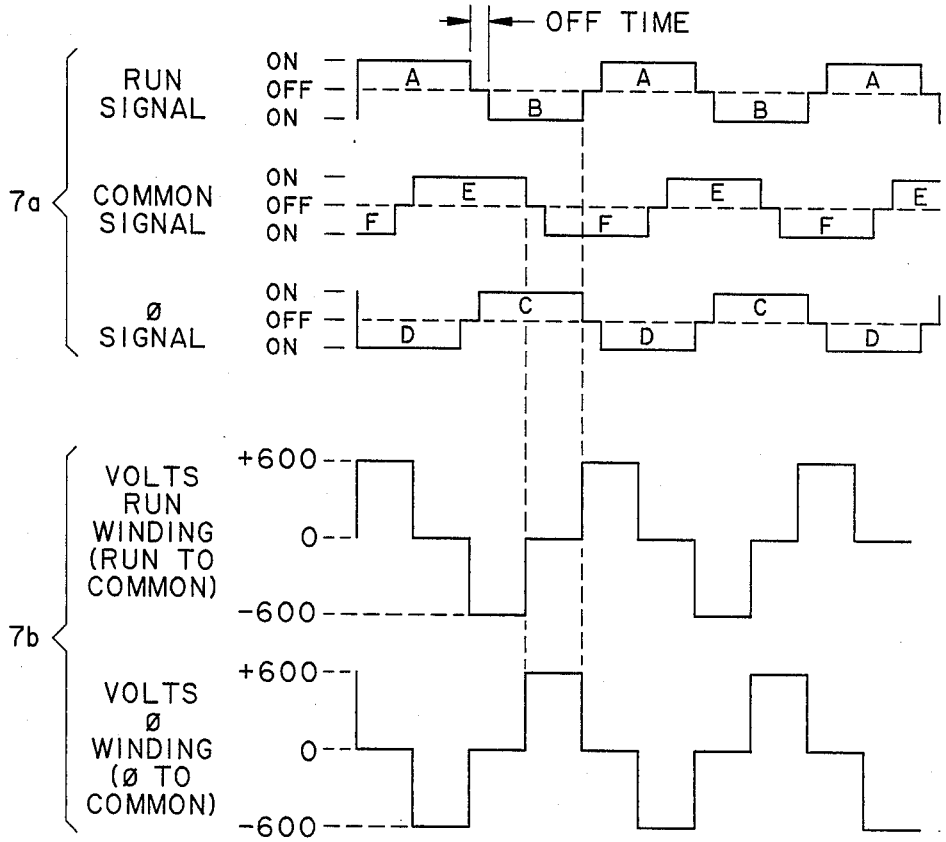
FIG. 7 depicts a wave form of the actively driven leads and windings of an x-ray tube in accordance with the present invention when operating at full power.

Turning to FIG. 6, the relative phased ouput of the circuitry of FIG. 5 is illustrated. The signals $\phi$ A and $\phi$ D are equivalent, as are $\phi$ B and $\phi$ C. As will be seen from FIG. 6, the off time provided by action of the Schmitt trigger delay circuit of FIG. 5 is also illustrated.

With the foregoing circuitry, a run signal, a common signal, and a phase signal are provided as illustrated in FIG. *7a*. The timings of each are taken in relation to the frequency of the drive frequency selection circuit 120 (FIG. 5). It will be seen by the figure that all signals have a generally equivalent frequency and wavelengths but differ from one another in phase. The phase of the common signal is shifted generally 90° from the run signal; and the phase of the phase signal is shifted generally 180° from the run signal. Accordingly, the run signal and the phase signal are generally 180° apart from one another and each 90° from the common signal. It is to be noted in conjunction with FIG. *7a*, that the run signal designated as "A" corresponds to the state of circuitry *72a*, and "B" corresponds to the state of circuitry *72b*. Likewise, the common signal "E" corresponds to circuit *70e*, common signal "F" to circuitry *70f*, $\phi$ signal "C" to circuitry *74c* and $\phi$ signal "d" to circuitry *74d*.

When the run winding 50 is supplied by both the run signal and the common signal, the resultant run winding voltage is a composite thereof. When the phase winding is supplied by both the phase signal and the common signal, a resultant phase winding voltage is a composite thereof. FIG. *7b* illustrates the wave shapes of the run winding signal and the phase winding signal, as formed by the above-noted combinations. The peak voltages, as illustrated, are 600 volts which can generate sufficient magnetic flux to control rotation of the rotor 44 and the anode 42 (FIG. 2).

Figure 8:
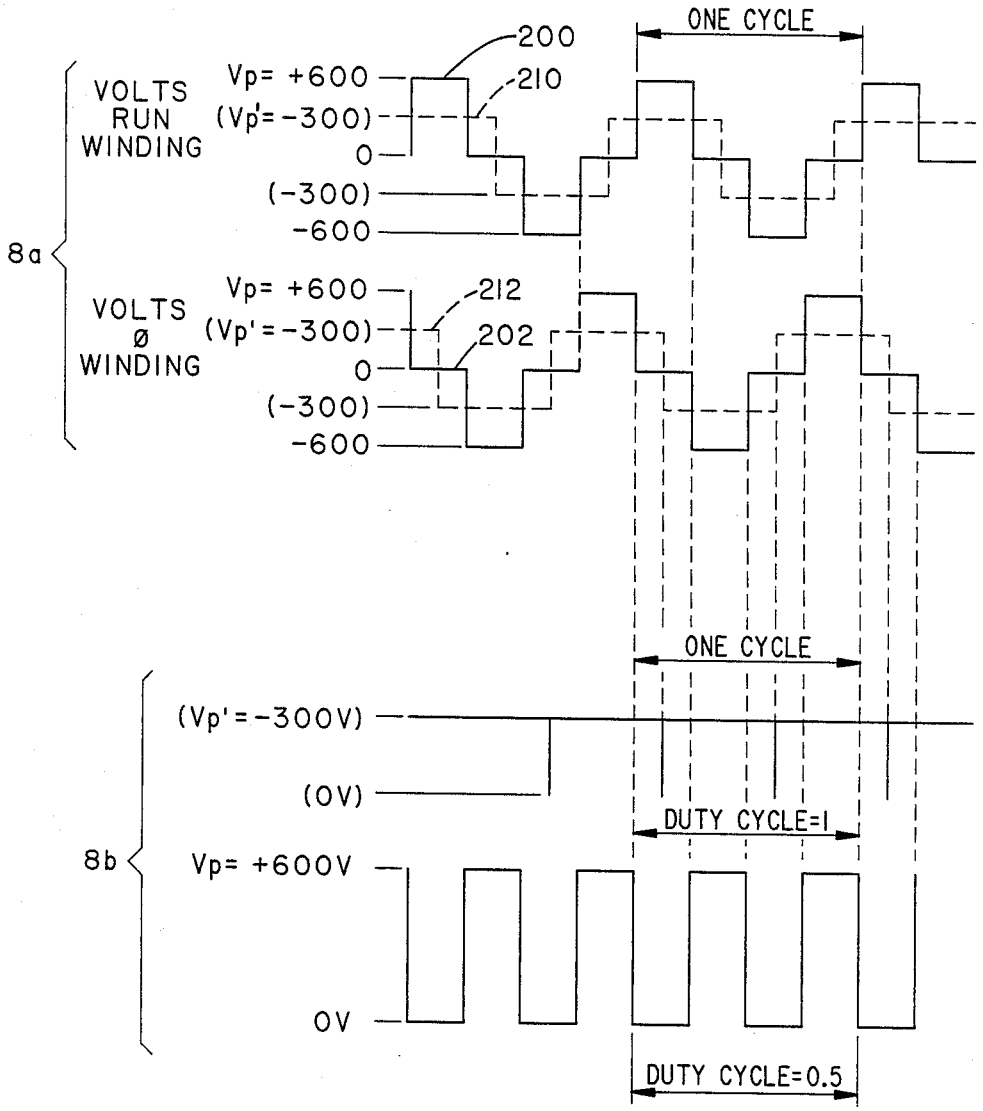
FIG. 8 depicts a wave form of the aggregrate voltage present at full power on a run winding and a phase winding of a stator of an x-ray tube in accordance with the present invention, and its associated duty cycle, compared to those obtained from conventional half-bridge drives.

Referring to FIG. 8, the ability to generate peak voltages in each coil for one half of a cycle generates increased RMS current levels through each coil over that which would be resultant by applying one-half the full (rail) voltage for a full cycle.

In FIG. 8A, the run winding voltage 200 and the $\phi$ winding voltage 202 of the present system are superimposed with corresponding levels 210, 212 (shown in phantom) which are achieved in a conventional half bridge drive. As RMS drive voltage equals the peak voltage multiplied by the square-root of the duty cycle as illustrated in FIG. *8b*. In the illustrated conventional system, this is 300 1×29 1 or 300 VRMS. In the present system, the RMS drive voltage equals 600 v×$\sqrt{0.5}$=424 VRMS. Hence, a net improvement of 41.4% is realized. Since power is proportional to voltage squared, a nominal doubling of power to the motor is produced. This results in increased torque in a three-lead two-winding stator as is common to x-ray tubes for a given power supply.

Figure 9:
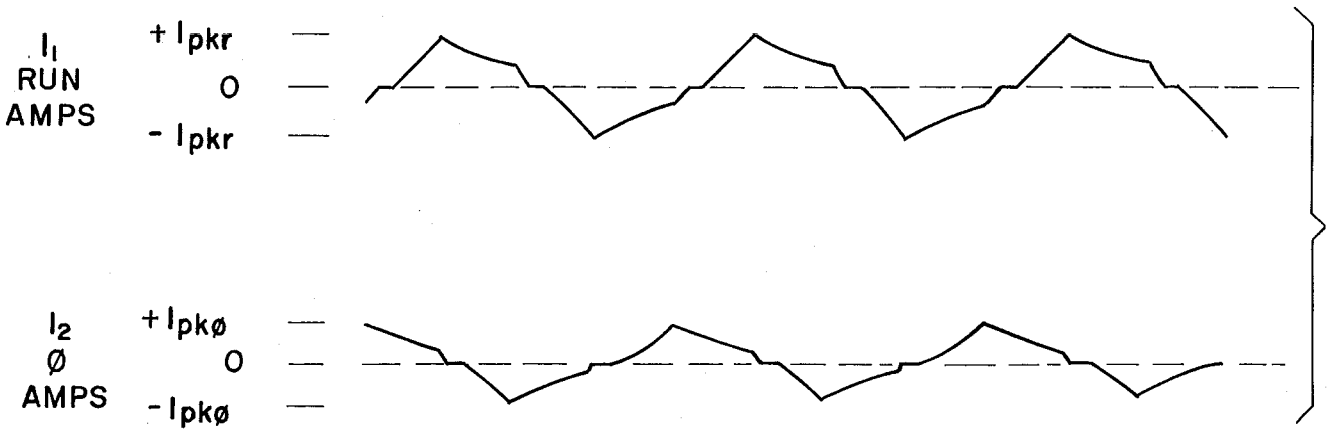
FIG. 9 depicts wave forms of resultant currents through the run winding and phase winding resultant from the drive of the present invention.

Turning back to FIG. 5, it will be seen that changing the frequency of the signal 120, changes the rotational velocity, resulting in acceleration, and deceleration of the rotating anode 42 accordingly. Signal 120 is modulated by signals A,B and C,D. These PWM signals may be modulated to produce the appropriate load current in each phase, up to the maximum current set by the load and supply voltage. Referring to FIG. 9, a waveshape of current provided in the run winding and the $\phi$ winding as a result of imposition of the aforenoted voltages is provided. The maximum output voltage will be a few percent lower than ideal due to conduction losses of the power control devices and the off time or "dead time" in the switching sequence added for safety of the switches. Sinusoidal modulation may be added to increase drive efficiency of the motor.

The ability to vary power and frequency is particularly important to the very large anode x-ray tubes. Rotating x-ray tubes resonate mechanically at various frequencies, causing loss of bearing life and focal spot motion. In diagnostic imaging such as computed tomography or digital radiography, focal spot motion degrades the resultant images. With the present invention, acceleration and deceleration of the rotating anode is governed to evade these resonant rotational frequencies. After a lowest resonant frequency has been passed during a deceleration, the rotating anode may be allowed to coast to a stop without need for further braking. It is preferred to allow this coasting in the event of high anode and bearing temperatures. Superior braking to that of D.C. braking is obtained by driving the anode to the desired coasting speed rather than applying a D.C. braking voltage for a nominal amount of time. Application of such D.C. voltage for a nominal time may leave the anode at an ill defined speed due to variations in line and load characteristics or the like.

The invention has been described with reference to the preferred embodiment. Obviously, modifications and alterations will occur to others upon reading and understanding the preceeding detailed description of the preferred embodiments. It is intended that the invention be construed as to include all such modifications and alterations insofar as they come within the scope of the appended claims or the equivalents thereof.

Having thus described a preferred embodiment, the invention is now claimed to be:

1. A computed tomography scanner comprising:

an x-ray tube mounted for movement about an image region, the x-ray tube having a rotatable rotating anode and an induction rotor means for inducing rotation thereof;

a sensor means disposed opposite the image region from the x-ray tube for receiving x-rays generated by the x-ray tube which have traversed the image region;

an image reconstruction means for processing data from the sensor means to form an image of a subject in the image region;

a stator means for inducing rotation of the rotor means, the stator means including at least:

a run winding operatively connected between a run signal generating means and a common node;

a phase winding operatively connected between a phase signal generating means and the common node;

a common lead operatively connected between a common signal generating means and the common node;

such that current produced in the run winding is a function of a run signal generated by the run signal generating means and a common signal generated by the common signal generating means, current produced in the phase winding is a function of a phase signal generated by the phase signal generating means, and the common signal, and current produced in the common lead is a combination of current produced in the run winding and the phase winding.

2. The computed tomography scanner of claim 1:

wherein the run signal, the common signal, and the phase signal all have generally equivalent periods of oscillation;

wherein the phase of the common signal is shifted from the run signal by a first phase shift and the phase signal is shifted from the run signal by a second phase shift; and, further comprising a rotational velocity control means for selectively varying at least one of (i) a pulse width of at least one of the run, common, and phase signals and (ii) a period of oscillation of run, common, and phase signals.

3. A radiographic apparatus comprising:

a cathode means for generating an electron stream;

a rotatable anode means in a path of electrons generated from the cathode means for generating ionizing radiation in response to collisions with electrons of the electron stream;

an induction rotor operatively connected to the rotatable anode means;

a stator for inducing rotation of the rotor, the stator including a run winding operatively connected between a first node and a common node for passing a run current therethrough and a phase winding operatively connected between a second node and the common node for passing a phase current therethrough;

a run signal generating means for generating a run signal, the run signal generating means being operatively connected to the first node to supply the run signal thereto;

a common signal generating means for generating a common signal, the common signal generating means being operatively connected with the common node to supply the common signal thereto;

a phase signal generating means for generating a phase signal, the phase signal generating means being operatively connected to the second node to supply the phase signal thereto;

such that a resultant current in the run winding is a composite of the run signal and the common signal, and a resultant current in the phase winding is a composite of the phase signal and the common signal.

4. The radiographic apparatus of claim 3 wherein:

the run signal generating means includes a positive run signal generating means for generating a positive portion of the run signal and a negative run signal generating means for generating a negative portion of the run signal;

the common signal generating means includes a positive common signal generating means for generating a positive portion of the common signal and a negative common signal generating means for generating a negative portion of the common signal; and, the phase signal generating means includes positive phase signal generating means for generating a positive portion of the phase signal and a negative phase signal generating means for generating a negative portion of the phase signal.

5. The radiographic apparatus of claim 4 further comprising:

a switching means for selectively enabling and disabling each of the positive and negative run signal generating means.

6. The radiographic apparatus of claim 5 wherein the phase of the common signal is shifted from the run signal by a first phase and the phase signal is shifted from the run signal by a second phase; and, further comprising a means for controlling the switching means to control the first and second phase shifts, hence the resultant run winding current and the resultant phase winding current to control motion of the induction rotor.

7. The radiographic apparatus of claim 6 further comprising a means for biasing the switching means to an off state during a selected disabled period thereof.

8. The radiographic apparatus of claim 3 wherein the run and phase signals include a series of pulses and further comprising a modulating means operatively connected with the run signal generating means and the phase signal generating means for modulating widths of the run and phase signal pulses.

9. The radiographic apparatus of claim 3 wherein the run, common, and phase signals oscillate with run, common, and phase frequency respecitvely, and further comprising a frequency varying means operatively connected with the run, common, and phase signal generating means for varying the frequency of the run, common, and phase signals.

10. The radiographic apparatus of claim 9 wherein the run signal generating means, the common signal generating means, and the phase signal generating means include means for generating their respective signals such that they have generally equivalent periods of oscillation, and wherein a first phase is defined in relation to a reference signal, a second phase is shifted approximately 90° from the first phase, and a third phase is shifted approximately 180° from the first phase.

11. The radiographic apparatus of claim 10 further comprising means for varying at least one of the reference frequency and a modulating means such that braking of the rotatable anode is effected.

12. A method of controlling rotation of a rotating anode of a radiographic tube, which anode is rotated by inductive interaction of an induction rotor with first and second windings, the method comprising:

(a) generating a reference frequency signal;

(b) generating a run signal having a first phase relation to the reference frequency signal;
(c) generating a common signal having a second phase relation to the reference frequency signal;
(d) generating a phase signal having a third phase relation to the reference frequency signal;
(e) combining the phase signal and the common signal to form a phase winding signal;
(f) combining the run signal and the common signal to form a run winding signal;
(g) applying the run winding signal to the first winding; and
(h) applying the phase winding signal to the second winding.

13. The method of controlling the rotating anode radiographic tube of claim 12 wherein the run and phase winding signals each include a train of pulses and further comprising selectively modulating the pulses of at least on of the run winding signal and the phase winding signal to control rotation of the rotating anode.

14. The method of controlling the rotating anode radiographic tube of claim 12 further comprising selectively varying the reference signal to control rotation of the anode.

15. The method of controlling the rotating anode radiographic tube of claim 14 wherein the run and phase winding signals each include a train of pulses and further comprising the step of selectively modulating the pulses of at least one of the run winding signal and the phase winding signal for further controlling rotation of the anode.

16. A speed control for controlling rotation of an anode in an x-ray tube that includes an inductive rotor connected to the anode and at least a run stator winding and a phase stator winding, the speed control comprising:

a rotatable anode means for generating ionizing radiation in response to collisions with electrons of an electron stream;

an induction rotor operatively connected to the rotatable anode means;

a stator for inducing rotation of the anode means, the stator including a run winding operatively connected between a first node and a common node for passing a run current therethrough, and a phase winding operatively connected between a second node and the common node for passing a phase current therethrough;

a run signal generating means for generating a run signal, the run signal means being operatively connected to the first node to supply the run signal thereto;

a common signal generating means for generating a common signal, the common signal generating means being operatively connected to the common node to supply the common signal thereto;

a phase signal generating means for generating a phase signal, the phase signal generating means being operatively connectd to the second node to supply the phase signal thereto;

such that a resultant current in the run winding is functionally related to the run signal and the common signal, and a resultant current in the phase winding is a composite of the phase signal and the common signal.

17. The speed control of claim 16 wherein:

the run signal generating means includes a positive run signal generating means for generating a positive portion of the run signal and a negative run signal generating means for generating a negative portion of the run signal;

the common signal generating means includes a positive common signal generating means for generating a positive portion of the common signal and a negative common signal generating means for generating a negative portion of the common signal; and, the phase signal generating means includes positive phase signal generating means for generating a positive portion of the phase signal and a negative phase signal generating means for generating a negative portion of the phase signal.

18. The speed control of claim 17 further comprising:

a switching means for selectively enabling and disabling each of the positive and negative signal generating means.

19. The speed control of claim 18 wherein the common signal is an oscillating signal, the run signal is an oscillating signal with a first phase relation to the common signal, and the phase signal is an oscillating signal with a second phase relationship to the common signal; and, further comprising a means for controlling the switching means to control the first and second phase relationships, hence the resultant run winding current and the resultant phase winding currents to control motion of the induction rotor.

20. A motor speed control for controlling rotational velocity of an induction rotor that is magnetically coupled with first and second stator windings, the speed control comprising:

an induction rotor;

a stator for inducing rotation of the rotor, the stator including a first winding operatively connected between a first node and a common node for passing a run current therethrough, and a second winding operatively connected between a second node and the common node for passing a phase current therethrough;

a run signal generating means for generating a run signal, the run signal generating means being operatively connected with the first node to supply the run signal thereto, the run signal generating means including:

(i) a positive run signal generating means for generating a positive portion of the run signal, (ii) a negative run signal generating means for generating a negative portion of the run signal;

a common signal generating means for generating a common signal, the common signal generating means being operatively connected with the common node to supply the common signal thereto, the common signal generating means including:

(i) a positive common signal generating means for generating a positive portion of the common signal, (ii) a negative common signal generating means for generating a negative portion of the common signal;

a phase signal generating means for generating a phase signal, the phase signal generating means being operatively connected with the second node to supply the phase signal thereto, the phase signal generating means including:

(i) a positive phase signal generating means for generating a positive portion of the phase signal, (ii) a negative phase signal generating means for generating a negative portion of the phase signal;

such that a resultant current in the run winding is a composite of the run signal and the common signal, and a resultant current in the phase winding is a composite of the phase signal and the common signal; and a switching means for selectively enabling and disabling each of the positive and negative signal generating means.

* * * * *